US009359789B2

(12) United States Patent
Pancel

(10) Patent No.: US 9,359,789 B2
(45) Date of Patent: Jun. 7, 2016

(54) SECURITY ASSEMBLY FOR USE WITH A SECURITY CONSOLE

(71) Applicant: Peter Michael Pancel, Barrie (CA)

(72) Inventor: Peter Michael Pancel, Barrie (CA)

(73) Assignee: ALL SOURCE SECURITY CONTAINERS MFG CORP., Barrie (CA)

( * ) Notice: Subject to any disclaimer, the term of this patent is extended or adjusted under 35 U.S.C. 154(b) by 0 days.

(21) Appl. No.: 14/173,879

(22) Filed: Feb. 6, 2014

(65) Prior Publication Data

US 2015/0218861 A1 Aug. 6, 2015

(51) Int. Cl.

| | |
|---|---|
| ***E05B 13/00*** | (2006.01) |
| ***E05B 17/20*** | (2006.01) |
| ***E05B 37/00*** | (2006.01) |
| ***E05B 37/02*** | (2006.01) |
| *E05B 65/46* | (2006.01) |
| *E05B 55/00* | (2006.01) |
| *E05B 47/00* | (2006.01) |
| *A47F 3/00* | (2006.01) |
| *A47F 9/00* | (2006.01) |

(52) U.S. Cl.

CPC ..... *E05B 17/2088* (2013.01); *E05B 13/004* (2013.01); *E05B 37/0034* (2013.01); *E05B 37/02* (2013.01); *A47F 3/002* (2013.01); *A47F 9/00* (2013.01); *E05B 47/0012* (2013.01); *E05B 55/005* (2013.01); *E05B 65/46* (2013.01); *Y10T 70/5097* (2015.04); *Y10T 70/5155* (2015.04); *Y10T 70/5199* (2015.04); *Y10T 292/42* (2015.04)

(58) Field of Classification Search

CPC ..... Y10T 70/5155; Y10T 70/5199; Y10T 70/5097; Y10T 292/57; Y10T 292/42; E05B 47/0012; E05B 55/005; E05B 65/46; E05B 17/2088; E05B 13/004; E05B 37/0034; E05B 37/02; A47F 3/002; A47F 9/00

USPC ..... 70/77–82, 85, 86, 91, 101, 102, 104, 70/106, 109, 124, 129, 131, 133, 134, 141, 70/142, 144; 109/59 R, 64

See application file for complete search history.

(56) References Cited

U.S. PATENT DOCUMENTS

| | | | | | |
|---|---|---|---|---|---|
| 1,462,828 | A | * | 7/1923 | Rixson | 70/104 |
| 1,687,388 | A | * | 10/1928 | Jorge | 70/107 |
| 1,744,988 | A | * | 1/1930 | Shaw | 70/104 |

(Continued)

*Primary Examiner* — Suzanne Barrett
*Assistant Examiner* — Morgan McClure
(74) *Attorney, Agent, or Firm* — Bereskin & Parr LLP; Isis E. Caulder

(57) ABSTRACT

A security assembly for use with a security console having a body and a door. The body of the security console has a plurality of walls defining an interior of the security console. The door of the security console is rotatably coupled to a first wall of the plurality of walls along a fixed edge of the door and movable between open and closed positions to provide and restrict, respectively, access to the interior of the security console. The security assembly comprises first and second cooperating members. The first cooperating member is configured to be mounted to the door near a free edge of the door. The second cooperating member is configured to be mounted to an inner surface of a second wall of the plurality of walls near an edge of the second wall, such that when the door is in the closed position, the first cooperating member is configured to securely engage the second cooperating member to restrict lateral deflection of the second wall relative to the free edge of the door. The edge of the second wall is adjacent to the free edge of the door when the door is in the closed position.

26 Claims, 11 Drawing Sheets

(56) References Cited

U.S. PATENT DOCUMENTS 3,405,962 A * 10/1968 Sushan ..... 292/346
3,761,119 A * 9/1973 Bennett et al. ..... 292/346
3,871,197 A * 3/1975 Waxgiser et al. ..... 70/63
4,895,010 A 1/1990 Legault
5,406,814 A * 4/1995 Zeager et al. ..... 70/102
5,547,239 A * 8/1996 Allenbaugh ..... 292/346
5,584,517 A * 12/1996 Simnacher ..... E05B 17/2088 292/340
H001766 H * 1/1999 Horton ..... 70/131
7,380,427 B2 6/2008 Elles et al.

* cited by examiner

SECURITY ASSEMBLY FOR USE WITH A SECURITY CONSOLE

FIELD

The described embodiments relate to a security assembly, and more particularly, to a security assembly for use with a security console to obstruct unauthorized access to the interior of the security console.

BACKGROUND

Security consoles are often used to store valuable items or confidential documents. As a result, there are ongoing attempts to develop more effective security assemblies for use with a security console to protect against tampering and unauthorized access to the Interior of the security console.

A common technique used by persons wishing to gain unauthorized access to the interior of a locked security console is to insert a narrow tool into a space between a side wall and the free end of the door of the security console. The narrow tool is then used to pry and deflect the side wall away from the door by a distance sufficient to disengage a latch or bolt used to secure the door in a closed position from a corresponding strike member.

Accordingly, there is a need for a security assembly for use with a security console that guards against tampering and unauthorized access to the interior of the security console. More particularly, there is a need for a security assembly that can restrict the lateral deflection of side walls of the security console relative to a door of the security console.

SUMMARY

The embodiments described herein provide in one aspect a security console comprising a body having a plurality of walls defining an interior of the security console. The security console further comprises a door being rotatably coupled to a first wall of the plurality of walls along a fixed edge of the door and movable between open and closed positions to provide and restrict, respectively, access to the interior of the security console. The security console further comprises a security assembly including a first cooperating member mounted to the door near a free edge of the door, and a second cooperating member mounted to an inner surface of a second wall of the plurality of walls near an edge of the second wall. The edge of the second wall is adjacent to the free edge of the door when the door is in the closed position. Further, when the door is in the closed position, the first cooperating member is configured to securely engage the second cooperating member to restrict lateral deflection of the second wall relative to the free edge of the door.

In another aspect, the first cooperating member includes an extending portion extending away from and being substantially perpendicular to an inner surface of the door. In addition, the second cooperating member includes a receiving portion having an engagement opening configured to securely engage the extending portion of the first cooperating member. The first and second cooperating members are mounted such that when the door is in the closed position, at least a portion of the extending portion of the first cooperating member is configured to securely engage with the engagement opening of the receiving portion of the second cooperating member to restrict lateral deflection of the second wall relative to the free edge of the door.

In yet another aspect, the first cooperating member further includes a substantially planar first mounting portion that is parallel to the inner surface of the door. Further, the extending portion of the first cooperating member is a flange extending away from a peripheral edge of the first mounting portion.

In yet another aspect, the second cooperating member further includes a second mounting portion that is substantially parallel to the inner surface of the second wall. In addition, the receiving portion of the second cooperating member extends away from and is substantially perpendicular to the inner surface of the second wall.

In yet another aspect, when the door is in the closed position, a portion of the first mounting portion of the first cooperating member is adjacent to a portion of the receiving portion of the second cooperating member.

In yet another aspect, the security console of claim 1 further comprises a door-lock assembly for selectively locking and unlocking the door. The door-lock assembly includes a locking member and a locking mechanism operably coupled to the locking member for moving the locking member between a locked position and an unlocked position. In one aspect, the door-lock assembly is mounted to the door near the free edge of the door such that:

- the locking mechanism extends through an opening in the door;
- when the door is in the closed position, the locking member is within the security console, and a release portion of the locking mechanism is accessible from outside the security console and operable to manipulate the locking mechanism to move the locking member between the locked position and the unlocked position;
- when the locking member is in the unlocked position, the door is movable between the open and closed positions; and
- when the locking member is in the locked position and the door is in the closed position, a portion of the locking member is configured to engage a strike member of the security console to prevent the door from moving between the open and closed positions.

In yet another aspect, the second cooperating member is the strike member.

In yet another aspect, the first cooperating member is mounted between the locking member and the inner surface of the door.

In yet another aspect, the first cooperating member further includes an opening through which the locking mechanism extends.

In yet another aspect, the locking mechanism further includes a code entry mechanism having a code entry portion for entering a security code. The locking mechanism also includes a key-entry mechanism having a key hole for receiving a security key. The code input portion of the code-entry mechanism and the key hole of the key-entry mechanism are accessible from outside the security console. Further, the locking mechanism is configured such that the release portion of the locking mechanism is operable to manipulate the locking mechanism to move the locking member from the locked position to the unlocked position if and only if at least one of:

- a unique security code is entered using the code input portion of the code-entry mechanism, and
- a unique security key is inserted into the key hole of the key-entry mechanism.

The embodiments described herein provide in another aspect a security assembly for use with a security console having a body and a door. The body of the security console has a plurality of walls defining an interior of the security console. The door is rotatably coupled to a first wall of the plurality of walls along a fixed edge of the door and movable between open and closed positions to provide and restrict, respectively, access to the interior of the security console. The security assembly comprises a first cooperating member configured to be mounted to the door near a free edge of the door. The security assembly further comprises a second cooperating member configured to be mounted to an inner surface of a second wall of the plurality of walls near an edge of the second wall, such that when the door is in the closed position, the first cooperating member is configured to securely engage the second cooperating member to restrict lateral deflection of the second wall relative to the free edge of the door. Further, the edge of the second wall is adjacent to the free edge of the door when the door is in the closed position.

In another aspect, the first cooperating member includes an extending portion and is configured to be mounted such that the extending portion extends away from and is substantially perpendicular to an inner surface of the door. In addition, the second cooperating member includes a receiving portion having an engagement opening configured to securely engage with the extending portion of the first cooperating member. Further, the first and second cooperating members are configured to be mounted such that when the door is in the closed position, at least a portion of the extending portion of the first cooperating member is configured to securely engage with the engagement opening of the receiving portion of the second cooperating member to restrict lateral deflection of the second wall relative to the free edge of the door.

In yet another aspect, the first cooperating member further includes a substantially planar first mounting portion and the extending portion of the first cooperating member is a flange extending away from a peripheral edge of the first mounting portion. Further, the first cooperating member is configured to be mounted such that the first mounting portion is substantially parallel to the inner surface of the door.

In yet another aspect, the second cooperating member further includes a second mounting portion and is configured to be mounted such that the second mounting portion is parallel to the inner surface of the second wall. Further, the receiving portion of the second cooperating member extends away from and is substantially perpendicular to the inner surface of the second wall.

In yet another aspect, the first and second cooperating members are configured to be mounted such that when the door is in the closed position, a portion of the first mounting portion of the first cooperating member is adjacent to a portion of the receiving portion of the second cooperating member.

In yet another aspect, the security console further includes a door-lock assembly for selectively locking and unlocking the door. The door-lock assembly includes a locking member and a locking mechanism operably coupled to the locking member for moving the locking member between a locked position and an unlocked position. Further, the door-lock assembly is mounted to the door near the free edge of the door such that:

- the locking mechanism extends through an opening in the door;
- when the door is in the closed position, the locking member is within the security console, and a release portion of the locking mechanism is accessible from outside the security console and operable to manipulate the locking mechanism to move the locking member between the locked position and the unlocked position;
- when the locking member is in the unlocked position, the door is movable between the open and closed positions; and
- when the locking member is in the locked position and the door is in the closed position, a portion of the locking member is configured to engage a strike member of the security console to prevent the door from moving between the open and closed positions.

In yet another aspect, the second cooperating member is configured to be the strike member.

In yet another aspect, the first cooperating member is configured to be mounted between the locking member and the inner surface of the door.

In yet another aspect, the first cooperating member further includes an opening, and is configured to be mounted such that the locking mechanism extends through the opening of the first cooperating member.

In yet another aspect, the locking mechanism further includes a code-entry mechanism having a code entry portion for entering a security code. The locking mechanism also includes a key-entry mechanism having a key hole for receiving a security key. Further, the door-lock assembly is configured to be mounted such that the code input portion of the code-entry mechanism and the key hole of the key-entry mechanism are accessible from outside the security console. In addition, the locking mechanism is configured such that the release portion of the locking mechanism is operable to manipulate the locking mechanism to move the locking member from the locked position to the unlocked position if and only if at least one of:

- a unique security code is entered using the code input portion of the code-entry mechanism, and
- a unique security key is inserted into the key hole of the key-entry mechanism.

Further aspects and advantages of the embodiments described herein will appear from the following description taken together with the accompanying drawings.

BRIEF DESCRIPTION OF THE DRAWINGS

A preferred embodiment of the present invention will now be described in detail with reference to the drawings, in which.

Figure 1:
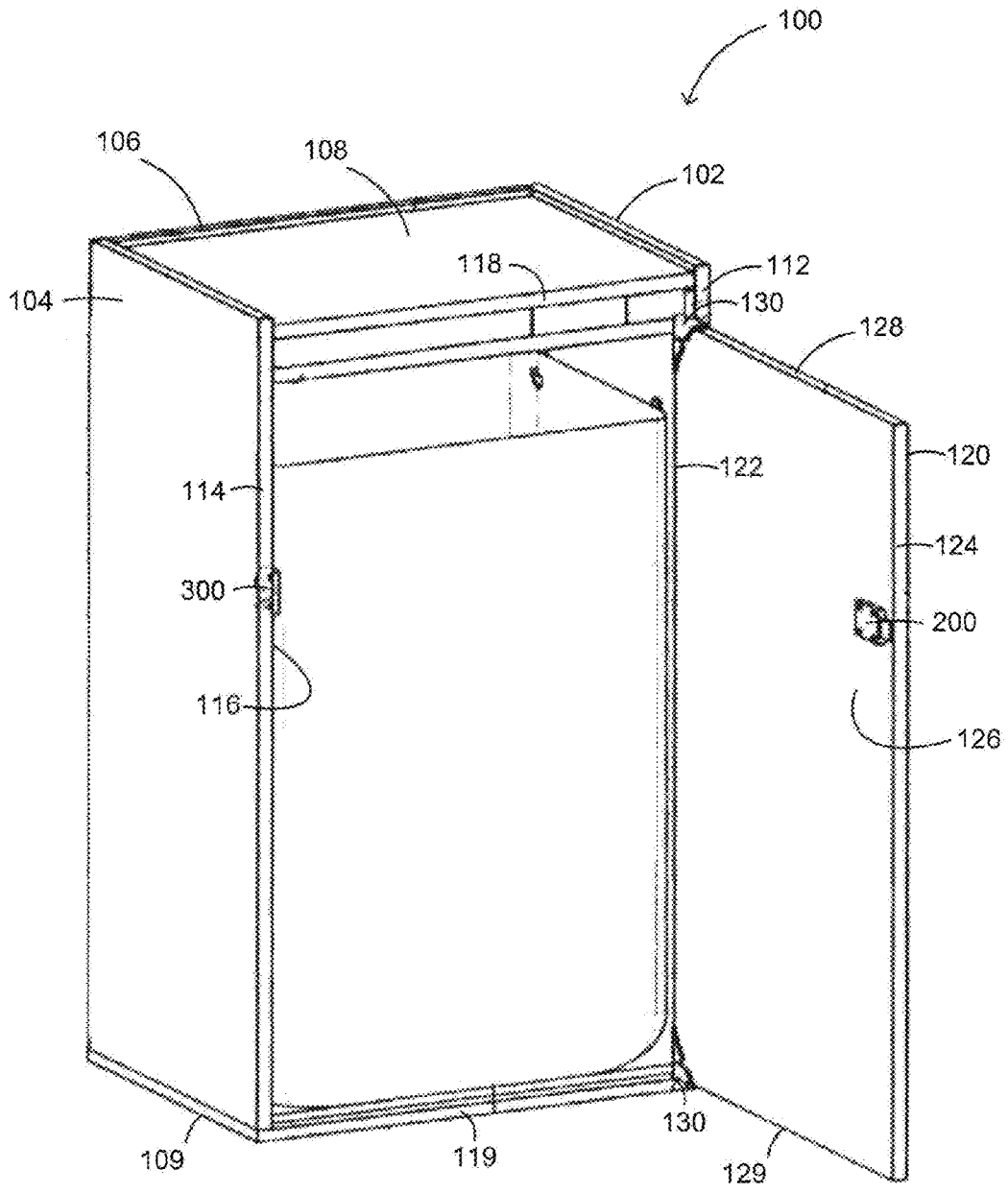
FIG. 1 is a perspective view of an embodiment of a security console comprising a security assembly.

The skilled person in the art will understand that the drawings, described below, are for illustration purposes only. The drawings are not intended to limit the scope of the applicant's teachings in anyway. Also, it will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DESCRIPTION OF VARIOUS EMBODIMENTS

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures, and components have not been described in detail so as not to obscure the embodiments described herein. Furthermore, this description is not to be considered as limiting the scope of the embodiments described herein in any way, but rather as merely describing the implementation of the various embodiments described herein.

Reference is made to FIG. 1, which shows an example security console 100. The body of the security console has a generally rectangular box shape, and a hollow interior defined by three side walls—namely, right sidewall 102, left sidewall 104, and end wall 106—extending between top 108 and base 109. Right sidewall 102 and left sidewall 104 are rectangular in shape, spaced apart, and parallel to each other. End wall 106 is also rectangular in shape and is perpendicular to right sidewall 102 and left sidewall 104. The rear edge of right sidewall 102 connects to the right edge of end wall 106 and the rear edge of the left sidewall 104 connects to the left edge of end wall 106.

In this embodiment, top 108 is horizontal and connects along three of its edges to the top edges of right sidewall 102, left sidewall 104, and end wall 106. Base 109 is also horizontal and connects along three of its edges to the bottom edges of right sidewall 102, left sidewall 104, and end wall 106.

To help maintain the security of contents stored within security console 100, right sidewall 102, left sidewall 104, end wall 106, top 108, and base 109 can be connected to one another using fasteners on the inside of security console 100 that cannot be tampered with from outside security console 100. However, it should be understood that right sidewall 102, left sidewall 104, end wall 106, top 108, and base 109 can be connected with one another in any manner that prevents tampering with security console 100. For example, the connections can be made using adhesive without the use of fasteners, or with a tongue and groove structure.

In one embodiment, right sidewall 102, left sidewall 104, end wall 106, top 108, and base 109 can be made of melamine particle board. However, it will be understood that other types of particle board or other materials such as solid wood, plastics, or metals may alternatively be used.

The fourth side of security console 100 is provided with door 120. Door 120 has right edge 122, left edge 124, top edge 128, and bottom edge 129. In this embodiment, door 120 is rotatably coupled along right edge 122 to edge 112 of right sidewall 102 by upper and lower hinges 130. Although two hinges are shown in this embodiment, it will be appreciated that a single hinge, such as a piano hinge, may alternatively be used. Hinges 130, or other rotatable connectors, may alternatively rotatably couple left edge 124, top edge 128, or bottom edge 129 of door 120 to edge 114 of left-side wall 104, edge 118 of top 108, or edge 119 of base 109, respectively.

Door 120 is movable between an open position as shown in FIG. 1, and a closed position in which left edge 124 of door 120 apposes edge 114 of left sidewall 104. It will be appreciated that when door 120 is in the closed position, access is restricted to the interior of security console 100.

In one aspect, when door 120 is in the closed position, a gap can be provided between top edge 128 of door 120 and edge 118 of top 108, to allow for insertion of items into the interior of security console 100 without requiring the opening of door 120. Top edge 128 of door 120 and the inner surface of top 108 can be horizontal, resulting in a rectangular opening or gap therebetween. Alternatively, an opening or gap may be provided elsewhere on door 120, such as through the body of door 120, or between a different edge of door 120 and a respective wall of the body of security console 100. The gap may have a movable cover such as a flap, and may also be omitted in which case door 120 is opened to allow items to be inserted into the interior of security console 100.

It will further be appreciated that the terms base, top, and side walls are used for ease of reference only, and are not meant to limit the configuration of security console 100. For example, in one embodiment, security console 100 may be configured such that end wall 106 is the base of security console 100, with door 120 being the top of security console 100.

A security assembly comprising cooperating members 200 and 300 is mounted to security console 100. Cooperating member 200 is mounted to inner surface 126 of door 120 and is adjacent to left edge 124 of door 120. Cooperating member 300 is mounted to inner surface 116 of left sidewall 104 and is adjacent to edge 114 of left sidewall 104. Cooperating members 200 and 300 are mounted at approximately the same height to allow cooperating member 200 to be adjacent to cooperating member 300 when the door is in the closed position. As will be described in more detail below, when door 120 is in the closed position, cooperating members 200 and 300 can securely engage with one another to restrict the lateral deflection of left sidewall 104 relative to left edge 124 of door 120.

It will be appreciated that cooperating member 300 may be mounted to a different inner surface of the body of security console 100. In one embodiment, no gap may be provided between top edge 128 of door 120 and edge 118 of top 108. In this case, cooperating member 300 may be mounted to the inner surface of top 108, with cooperating member 200 being mounted to inner surface 126 of door 120 adjacent to top edge 128 of door 120. Cooperating members 200 and 300 can be mounted at approximately the same horizontal positions along top edge 128 of door 120 and edge 118 of top 108, respectively, such that when door 120 is in the closed position, cooperating member 200 is adjacent to cooperating member 300. In this way, when the door is in the closed position, cooperating members 200 and 800 can securely engage with one another to restrict lateral deflection of top 108 relative to top edge 128 of door 120. In this embodiment, door 120 may remain coupled along right edge 122 to edge 112 of right sidewall 102, or alternatively may be rotatably coupled along bottom edge 129 to edge 119 of base 109.

Figure 2A:
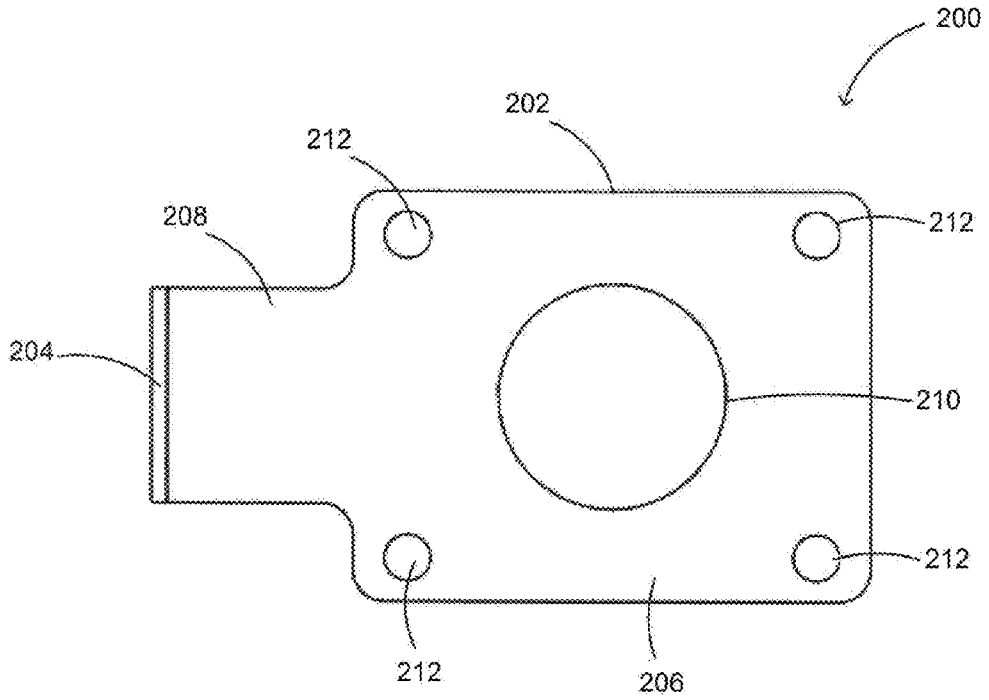
FIG. 2A is a top view of a first cooperating member of the security assembly of FIG. 1.
Figure 2B:
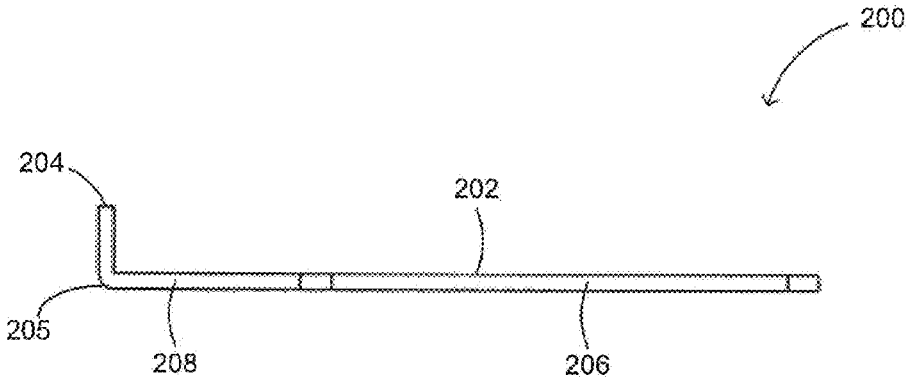
FIG. 2B is a side view of the first cooperating member of FIG. 2A.

FIGS. 2A and 2B illustrate a top and side view, respectively, of cooperating member 200. Cooperating member 200 includes base plate 202 and flange 204. Base plate 202 consists of mounting portion 206 and tab 208, which extends from an edge of and is parallel to mounting portion 206. Flange 204 extends upwardly from edge 205 of tab 208 and is substantially perpendicular to base plate 202.

In one aspect, base plate 202 may have cutout opening 210. As will be discussed with reference to FIGS. 6A-6D and corresponding cutout opening 610 of base plate 602, opening 210 can be used in embodiments in which cooperating member 200 is integrated with a door-lock assembly, to allow for a portion of a locking mechanism of the door-lock assembly to extend through opening 210. However, it will be appreciated that in some embodiments, opening 210 may be omitted.

It will further be appreciated that while opening 210 is shown as being circular in shape, opening 210 may also be oval, square, rectangular, or any other shape that allows for a portion of a locking mechanism to extend therethrough. In one aspect, opening 210 may extend inwardly from an edge of mounting portion 206, resulting in a U-shaped mounting portion 206.

Base plate 202 may include a plurality of mounting holes 212 that allow for insertion of fasteners such as screws or bolts therethrough to secure cooperating member 200 to inner surface 126 of door 120. It will be appreciated that base plate 202 may be mounted to inner surface 126 of door 120 using any type of fastener or other mounting means that prevents tampering with cooperating member 200. For example, cooperating member 200 may also be mounted using rivets, or structural adhesives such as epoxy, in which case plurality of mounting holes 212 may be omitted.

In one embodiment, cooperating member 200 can be made of steel. In one aspect, cooperating member 200 may be made of nickel-plated stamped steel. It should be understood, however, that other types of suitable metals or materials capable of performing the functions of cooperating member 200 described herein may alternatively be used. In one embodiment, both door 120 and base plate 202 may be made of metals suitable for welding base plate 202 to door 120.

Figure 3A:
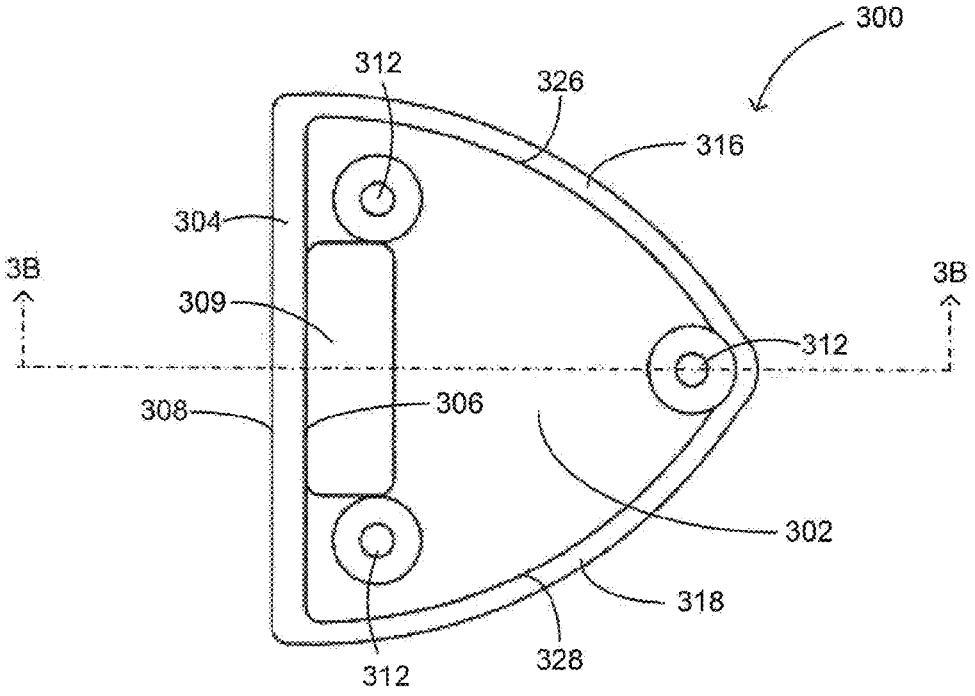
FIG. 3A is a top view of a second cooperating member of the security assembly of FIG. 1.

FIGS. 3A, 3B, 3C, and 3D illustrate a top view, a side sectional view taken along line 3B-3B of FIG. 3A, a bottom view, and a front view, respectively, of cooperating member 300.

Figure 3B:
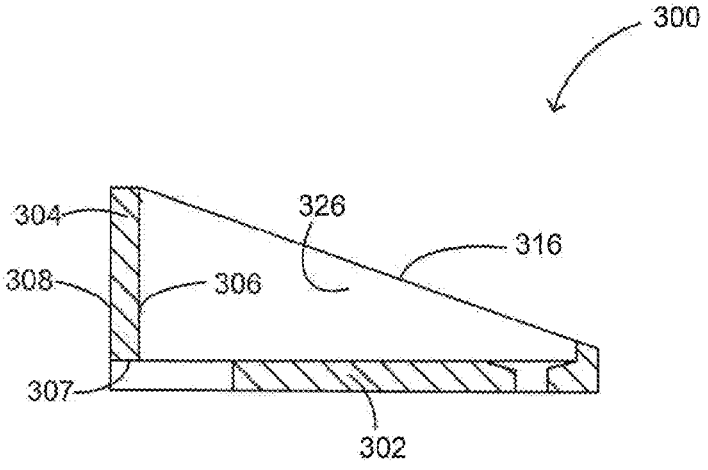
FIG. 3B is a side sectional view of the second cooperating member of FIG. 3A taken along line 3B-3B of FIG. 3A.

Referring to FIGS. 3A and 3B, cooperating member 300 has base 302, which has a generally circumlinear triangular shape with a flat front end. Cooperating member 300 further includes peripheral walls—consisting of front wall 304 and rear sidewalls 316 and 318—which extend upwardly from and around the peripheral edges of base 302. In one aspect, rear sidewalls 316 and 318 slope down rearwardly from front wall 304 toward the rear end of cooperating member 300. As is more clearly seen in FIG. 4, the upward-facing surface of base 302 and inward-facing surfaces 306, 326, and 328 of front wall 304 and rear sidewalls 316 and 318, respectively, define an interior hollow space of cooperating member 300.

Base 302 may include a plurality of mounting holes 312 that allow for insertion of fasteners such as screws or bolts therethrough to secure cooperating member 300 to inner surface 116 of left sidewall 104. It will be appreciated that cooperating member 300 may be mounted to inner surface 116 of left sidewall 104 using any type of fastener or other mounting means that prevents tampering with cooperating member 300. For example, cooperating member 300 may also be mounted using rivets, or structural adhesives such as epoxy, in which case plurality of mounting holes 312 may be omitted.

Figure 3C:
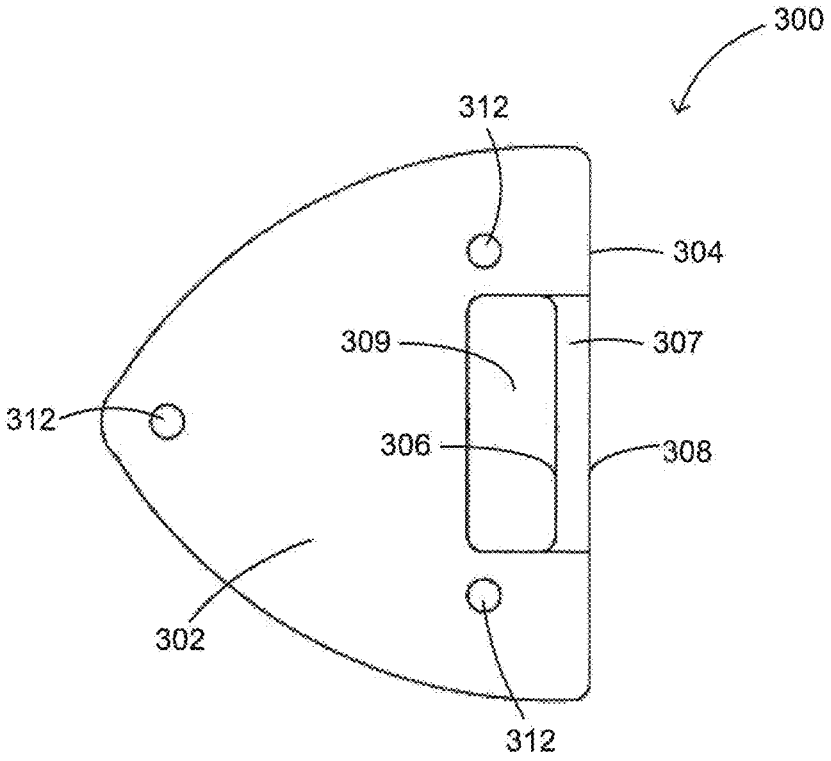
FIG. 3C is a bottom view of the second cooperating member of FIG. 3A.
Figure 3D:
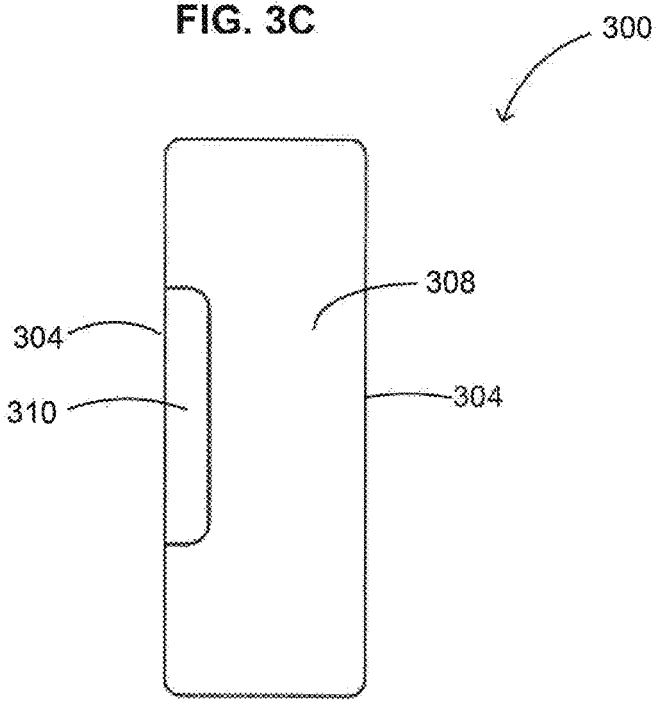
FIG. 3D is a front view of the second cooperating member of FIG. 3A.

Referring to FIGS. 3C and 3D, front surface 308 of cooperating member 300 has an elongated opening 310 that recedes inwardly into base 302 to define rectangular opening 309 in base 302. Elongated opening 310 further defines strike surface 307 of front wall 304. It will be appreciated that elongated opening 310 is configured to receive flange 204 of cooperating member 200.

In one embodiment, cooperating member 300 can be made of zinc. In one aspect, cooperating member 300 can be made of nickel-plated zinc. It should be understood, however, that other types of suitable metals or materials capable of performing the functions of cooperating member 300 described herein may alternatively be used. For example, cooperating member 300 may also be made from suitable structural plastics or carbon fibers. In one embodiment, both left sidewall 104 and base 302 may be made of metals suitable for welding base 302 to left sidewall 104.

Figure 4:
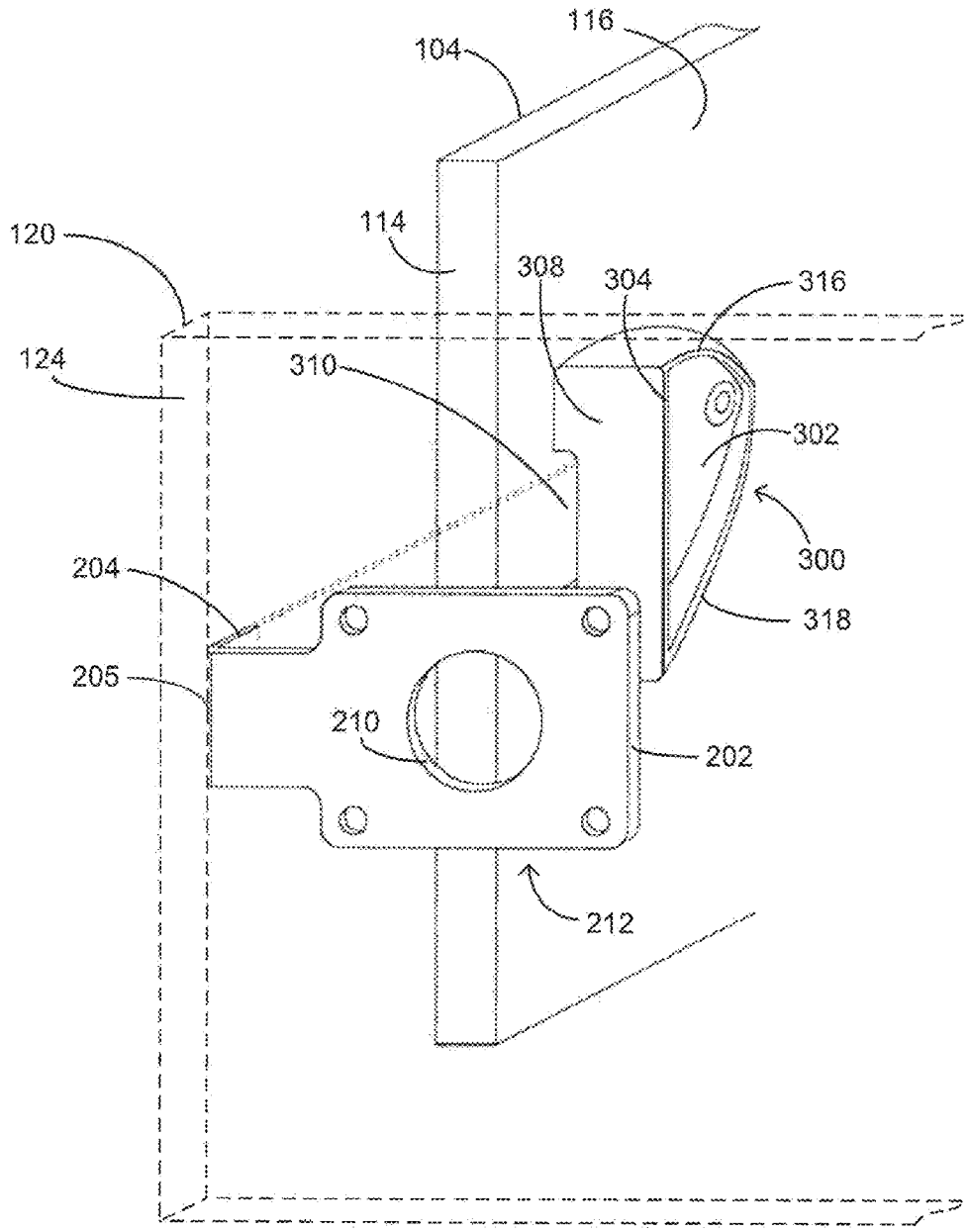
FIG. 4 is an exploded view of the security assembly of FIG. 1.

FIG. 4 provides an exploded view of a portion of security console 100 with cooperating members 200 and 300 in respective mounting positions. In this embodiment, the bottom surface of base plate 202 of cooperating member 200 is disposed against inner surface 126 of door 120 (shown in dashed lines), and cooperating member 200 is oriented such that edge 205 is adjacent and substantially parallel to left edge 124 of door 120.

The bottom surface of base 302 of cooperating member 300 is disposed against inner surface 116 of left sidewall 104. Cooperating member 300 is oriented such that front surface 308 is substantially parallel to and near edge 114 of left sidewall 104 and elongated opening 310 is aligned to receive and securely engage flange 204 of cooperating member 200 when door 120 is moved into a closed position. In this embodiment, front surface 308 of cooperating member 300 is positioned away from edge 114 of left sidewall 104 by a distance sufficient to allow left edge 124 of door 120 to be adjacent to inner surface 116 of left sidewall 104 and the outer surface of door 120 to be substantially flush with edge 114 of left sidewall 104 when the door is moved into the closed position. However, it will be appreciated that in an alternative embodiment—in which security console 100 is configured such that inner surface 126 of door 120 is flush with edge 114 of left sidewall 104, for example—cooperating member 300 may be positioned such that front surface 308 of cooperating member 300 is substantially flush with edge 114 of left sidewall 104.

It will be appreciated that instead of being provided at the base of front wall 304 and receding inwardly into base 302, elongated opening 310 may be provided elsewhere on front wall 304. In one embodiment, elongated opening 310 may be provided in the middle of front wall 304 and extend between front surface 308 and inward-facing surface 306 of front wall 304. In this case, cooperating member 200 may be positioned away from left edge 124 of door 120 by a distance sufficient to allow flange 204 to be received by and securely engaged with elongated opening 310.

Figure 5A:
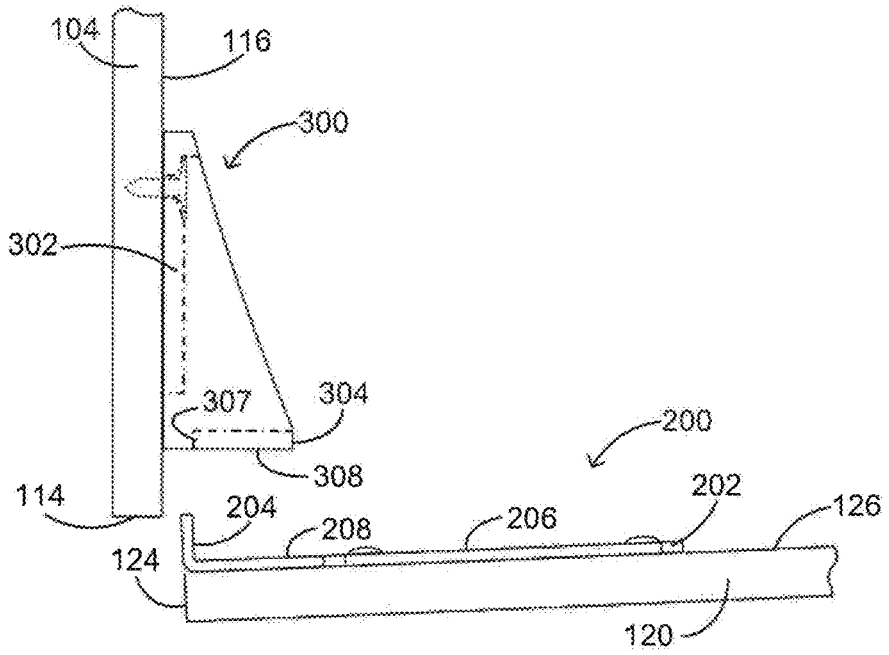
FIG. 5A is a top sectional view of a portion of the security console comprising the security assembly of FIG. 1.
Figure 5B:
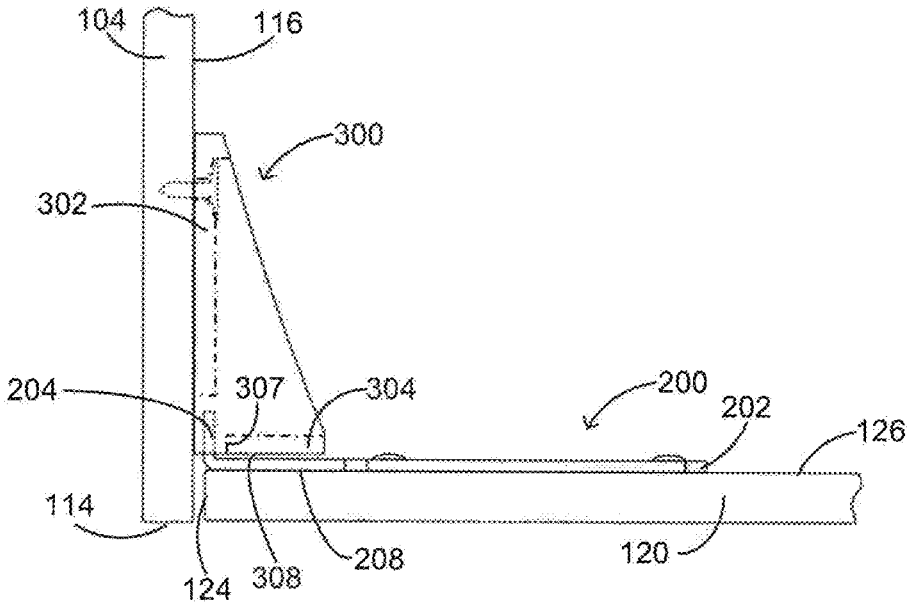
FIG. 5B is another top sectional view of a portion of the security console comprising the security assembly of FIG. 1.

FIGS. 5A and 5B provide a top sectional view of a portion of security console 100, with cooperating members 200 and 300 shown mounted in their respective mounting positions as described with reference to FIG. 4, FIG. 5A shows door 120 in a partially open position, and FIG. 5B shows door 120 in a closed position.

Referring to FIG. 5B, when door 120 is in the closed position, tab 208 of cooperating member 200 is adjacent to front surface 308 of cooperating member 300, and flange 204 is received by and securely engaged with elongated opening 310. When securely engaged, flange 204 is adjacent to strike surface 307 of front wall 304. As a result, an attempt to separate left sidewall 104 from left edge 124 of door 120—by inserting a narrow tool between left edge 124 of door 120 and left sidewall 104, for example—brings flange 204 into engagement with strike surface 307 of front wall 304. In this way, lateral deflection of left sidewall 104 relative to left edge 124 of door 120 is restricted.

It will be appreciated that while elongated opening 310 and flange 204 are shown in FIGS. 2 to 4 as having elongated rectangular profiles, it should be understood that elongated opening 310 and flange 204 may take on any shape that allows for flange 204 to be received by and securely engaged with cooperating member 300 so to restrict lateral deflection of left sidewall 104 relative to door 120.

It will further be appreciated that in a different embodiment, flange 204 may be replaced by any other suitable extending mating member that can extend away from and be substantially perpendicular to base plate 202 of cooperating member 200. For example, in one embodiment, flange 204 may be replaced with a cylindrical member, such as a pin that is welded, or secured through other means, in an upright position to, for example, the center of tab 208 or any other portion of base plate 202.

In one embodiment, tab 208 and opening 210 of cooperating member 200 may be omitted, and flange 204 may be replaced with, for example, a pin disposed in the center of mounting portion 206 and extending away from mounting portion 206. In this case, elongated opening 310 of cooperating member 300 may be replaced with a circular opening corresponding to the profile of the pin. The circular opening may extend between front surface 308 and inward-facing surface 306 of front wall 304 and may be provided on a portion of front wall 304 that is suitable for securely engaging with the pin of cooperating member 200.

It will be appreciated that in some embodiments, an extending member such as a rod or pin may be used in place of cooperating member 200. In one aspect, the extending member may be welded, or mounted through other means, to inner surface 126 of door 120 such that it extends away from and is substantially perpendicular to inner surface 126 of door 120. It will be appreciated that the extending member can be positioned to securely engage cooperating member 300 when the door is moved into the closed position.

It will further be appreciated that while rear sidewalls 316 and 318 may provide increased structural integrity to cooperating member 300, in some embodiments rear sidewalls 316 and 318 may be omitted. For example, in one embodiment, cooperating member 300 may be a bracket consisting of a planar base plate and a flange extending upwardly from a periphery of the base plate and having an opening for receiving and engaging flange 204 or a different extending member of cooperating member 200.

It will further be appreciated that a flat plate similar to front wall 304 may be used in place of cooperating member 300. In this case, the flat plate may be welded, or mounted through other means, to inner surface 116 of left sidewall 104 such that it extends away from inner surface 116 in a manner similar to front wall 304. The flat plate may have an opening similar to elongated opening 310, or any other suitable configuration for securely engaging an extending member of cooperating member 200.

Figure 6A:
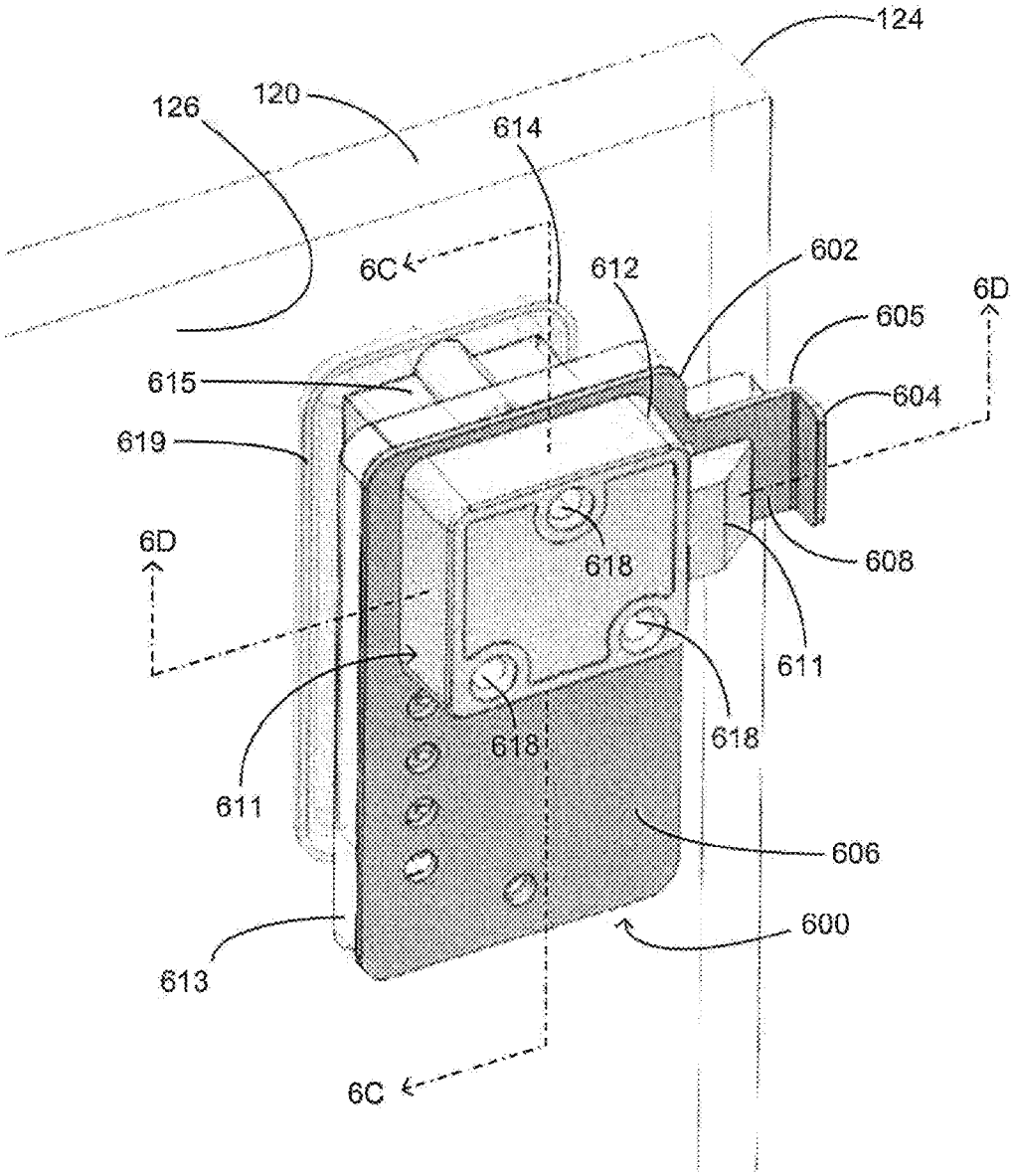
FIG. 6A is a perspective view of a portion of another embodiment of the security assembly.
Figure 6B:
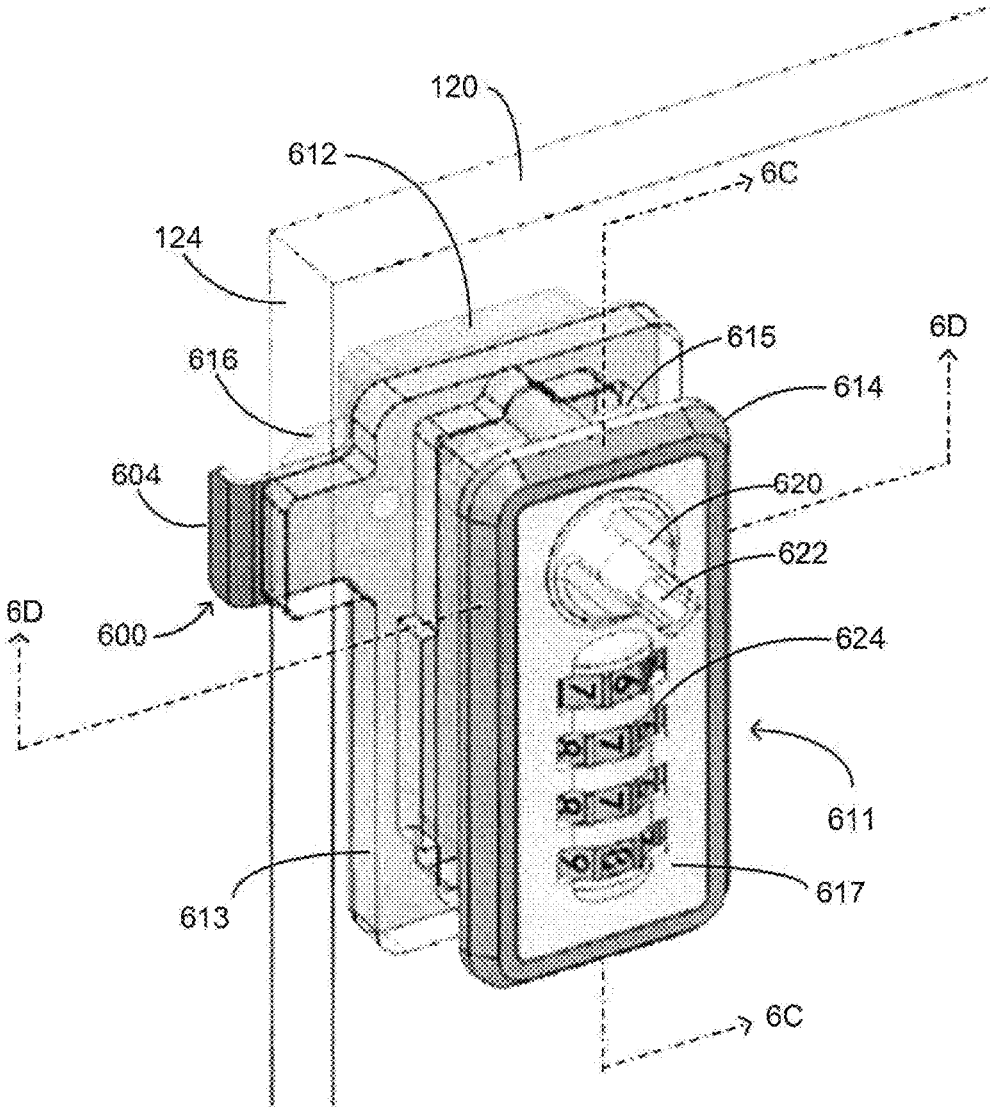
FIG. 6B is another perspective view of the portion of the security assembly of FIG. 6A.
Figure 6C:
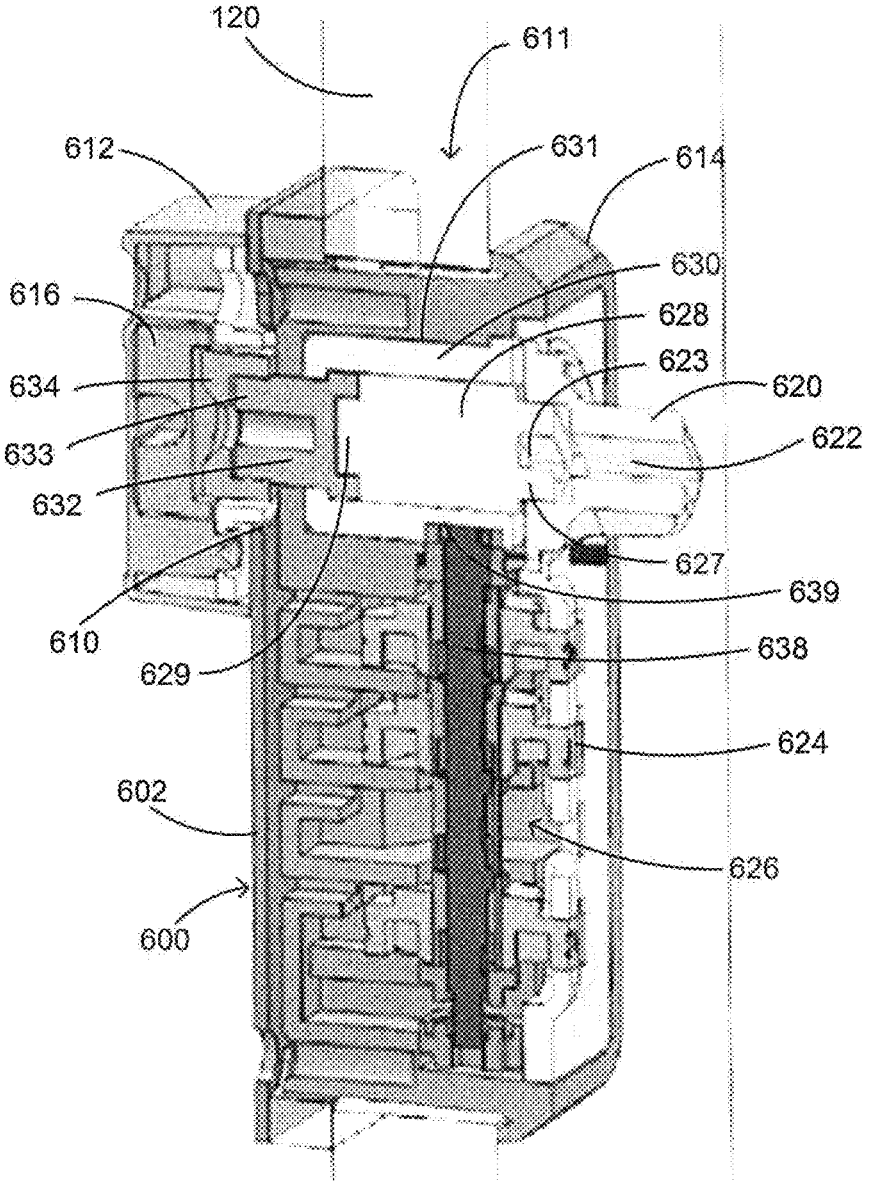
FIG. 6C is a sectional view of the portion of the security assembly of FIG. 6A taken along line 6C-6C of FIGS. 6A and 6B.
Figure 6D:
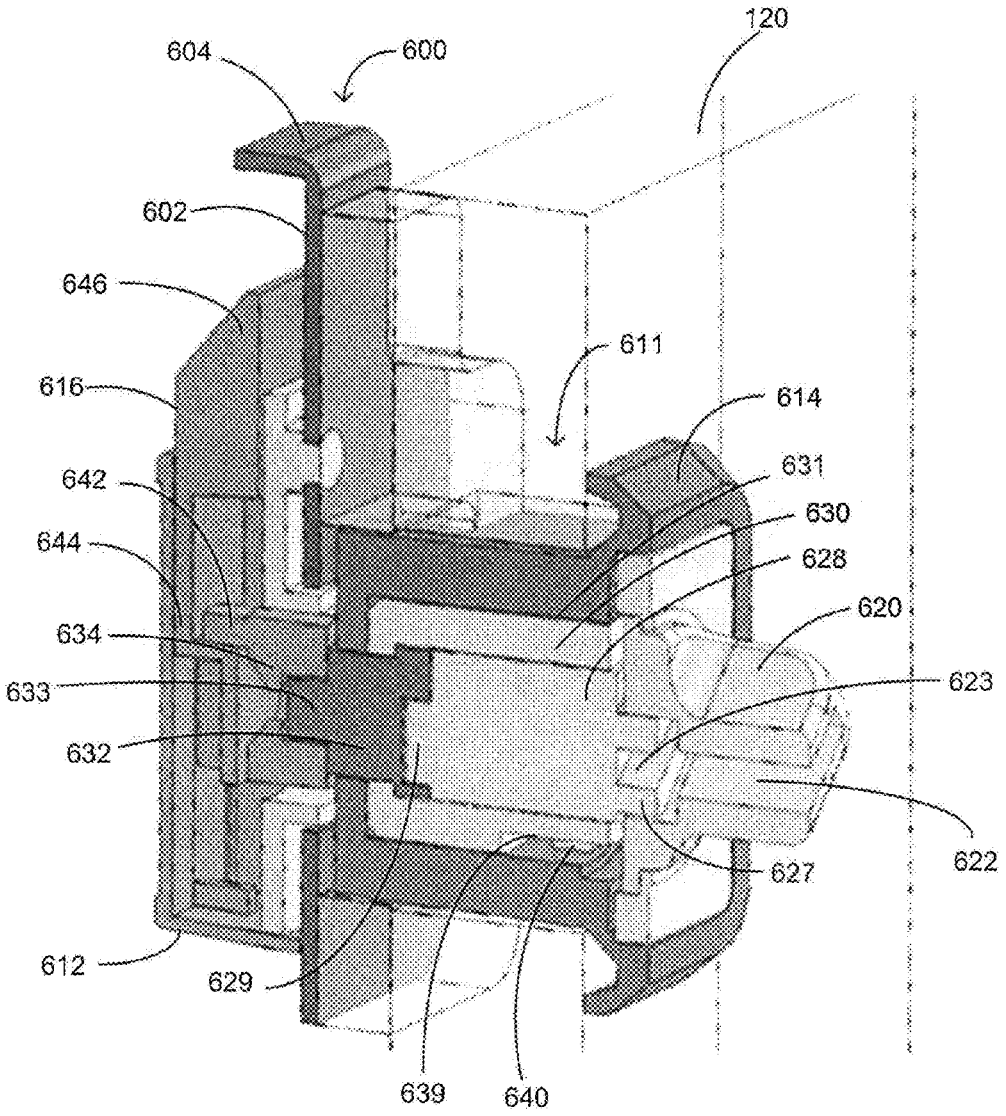
FIG. 6D is a sectional view of the portion of the security assembly of FIG. 6A taken along line 6D-6D of FIGS. 6A and 6B.

FIGS. 6A and 6B provide perspective views of another embodiment of a security assembly for use with security console 100. FIGS. 6C and 6D illustrate sectional views of the security assembly taken along lines 6C-6C and 6D-6D, respectively, of FIGS. 6A and 6B. In one embodiment, the security assembly can include cooperating member 300 described above, cooperating member 600, and door lock assembly 611.

Referring to FIG. 6A, cooperating member 600 can be similar to cooperating member 200 described above. Cooperating member 600 includes base plate 602 and flange 604. Base plate 602 consists of mounting portion 606 and tab 608, which extends from an edge of and is parallel to mounting portion 606. Flange 604 extends upwardly from edge 605 of tab 608 and is substantially perpendicular to base plate 602. Base plate 602 may have cutout opening 610 (partially shown in FIG. 6C), through which components of a locking mechanism housed in door-lock assembly 611 may extend.

Door-lock assembly 611 includes inner housing 612, support plate 613, and outer housing 614, which together house components of a locking mechanism for selectively locking and unlocking door 120 of security console 100 by extending and retracting latch 616. In this embodiment, door 120 has a hole that extends from inner surface 126 to its outer surface and is shaped to receive internal portion 615 of outer housing 614. Support plate 613 includes a similarly shaped hole extending therethrough for allowing internal portion 615 of outer housing 614 to extend through support plate 613. Support plate 613 may have a shape corresponding to the shape of base plate 602 of cooperating member 600, and can be positioned against inner surface 126 of door 120 and oriented such that the hole extending through support plate 613 aligns with the hole extending through door 120.

Cooperating member 600 can be disposed between inner surface 126 of door 120 and latch 616. In one aspect, cooperating member 600 can be positioned against support plate 613, in which case base plate 602 of cooperating member 600 can cover the hole in support plate 613 for receiving internal portion 615 of outer housing 614.

Outer housing 614 is disposed on the outer surface of door 120, and has internal portion 615 that extends from the outer surface of door 120, through the holes in door 120 and support plate 613 shaped for receiving internal portion 615, and up to base plate 602 of cooperating member 600.

Inner housing 612 is disposed against base plate 602 of cooperating member 600, and is oriented such that latch 616 extends toward flange 604 and is substantially parallel to base plate 602.

In one embodiment, a plurality of machine screws 618 may be used to secure cooperating member 600 and door-lock assembly 611 to door 120. In one aspect, inner housing 612 can include a plurality of mounting holes for insertion of machine screws 618 therethrough. Base plate 602 may also include a plurality of mounting holes for insertion of machine screws 618 therethrough. The mounting holes of base plate 602 can be aligned with those of inner housing 612.

Outer housing 614 can have a corresponding plurality of tapped mounting holes extending partially into internal portion 615 for securing machine screws 618 therein. The tapped mounting holes of outer housing 614 can be aligned with the plurality of mounting holes of base plate 602 and inner housing 612. Plurality of machine screws 618 can extend through the mounting holes of inner housing 612 and base plate 602, and can be inserted into the tapped mounting holes of outer housing 614.

To secure cooperating member 600 and door-lock assembly 611 to door 120, the plurality of machine screws 618 can be tightened, bringing together outer housing 614 and inner housing 612. As a result, periphery 619 of outer housing 614 is pressed against the outer surface of door 120 around the hole of door 120 into which internal portion 615 extends, and inner housing 612 is pressed against base plate 602, base plate 602 is pressed against support plate 613, and support plate 613 is pressed against inner surface 126 of door 120 around the hole of door 120 through which internal portion 615 of outer housing 614 extends.

It will be appreciated that in some embodiments, support plate 613 may be omitted. In this case, the locking mechanism components of door-lock assembly 611 may be configured such that internal portion 615 of outer housing 614 can extend into door 120 up to inner surface 126 of door 120, and base plate 602 of cooperating member 600 may be disposed against inner surface 126 of door 120.

Referring to FIG. 6B, external portion 617 of outer housing 614 has a plurality of openings through which knob 620 having key hole 622 and combination wheels 624 of code input mechanism 626 (shown in FIG. 6C) extend. Knob 620 is disposed in outer housing 614 and is operably coupled to latch 616 through the locking mechanism housed in inner housing 612 and outer housing 614.

As will be described in more detail below with reference to FIGS. 6C and 6D, when either of a specific security key is inserted into key hole 622 or combination wheels 624 are manipulated to display a predetermined four-digit security code, knob 620 becomes operable to manipulate the locking mechanism to retract latch 616 from an extended position into inner housing 612.

In one aspect, latch 616 may be spring biased, such that when knob 620 is rotated to retract latch 616 into inner housing 612 and subsequently released, latch 616 returns to its extended position. It will be appreciated that door-lock assembly 611 may be configured to use a dead bolt, or any other suitable locking member that can perform the functions as described herein, in place of latch 616.

Referring to FIG. 6C, the locking mechanism of door-lock assembly 611 is disposed in accommodating internal grooves of outer housing 614. The locking mechanism includes knob 620, code input mechanism 626, and a rotatable cylindrical core consisting of key-release plug 628, code-release hull 630, core-extending member 632, and latch engagement member 634.

The interior surface of knob 620 has a rectangular groove for mating with outer rectangular protruding member 627 of key-release plug 628. Key-release plug 628 is disposed within and rotatable relative to code-release hull 630, which itself is housed within and rotatable relative to core housing groove 631 of outer housing 614. Inner rectangular protruding member 629 of key-release plug 628 mates with an accommodating rectangular groove of core-extending member 632. Core-extending member 632 is also rotatable relative to code-release hull 630 and extends outwardly from outer housing 614 past inner surface 126 of door 120 and through opening 610 of base plate 602. Rectangular protruding member 633 of core-extending member 632 is mated with an accommodating groove of rotatable latch engagement member 634 disposed within inner housing 612. Referring to FIG. 6D, rectangular engagement portion 642 of latch engagement member 634 is disposed within a recess on the underside of proximal portion 644 of latch 616.

Referring back to FIG. 6C, code input mechanism 626 is disposed below the core of the locking mechanism, and comprises core-locking rod 638 which is pivotally coupled to a plurality of combination wheels 624. The top of core-locking rod 638 extends into outer-surface groove 639 of code-release hull 630 and engages notch 640 (shown in FIG. 6D) to prevent code-release hull 630 from rotating relative to core housing groove 631. The opposing end of core-locking rod 638 extends into an accommodating groove at the bottom of outer housing 614.

It will be appreciated that code input mechanism 626 is configured to push core-locking rod 638 downward to no longer engage notch 640 of groove 639 when combination wheels 624 are manipulated to align in a pre-determined configuration, such as a configuration in which a pre-determined four-digit security code is displayed through the openings of external portion 617 of outer housing 614. When core-locking rod 638 is pushed down to no longer engage notch 640, code-release hull 630 becomes rotatable relative to core housing groove 631.

Accordingly, it will be understood that entering a predetermined security code using combination wheels 624 enables code-release hull 630 to rotate relative to core housing groove 631. If combination wheels 624 subsequently become misaligned such that the predetermined four-digit security code is no longer displayed through the openings of external portion 617 of outer housing 614, code-input mechanism 626 is configured to return core-locking rod 638 to its original position, in which the top of core-locking rod 638 engages notch 640 and prevents code-release hull 630 from rotating relative to core housing groove 631.

In one aspect, key-release plug 628 and code-release hull 630 may be configured to interlock with one another through a pin-and-tumbler lock design (not shown) comprising one or more key-and-driver pin sets.

It will be appreciated that in a locked position, one or more driver pins can obstruct the rotation of key-release plug 628 relative to code-release hull 630. To enter into an unlocked configuration, a security key can be inserted through key hole 622 and into key-receiving slot 623 (which may extend further into key-release plug 628 than shown in FIGS. 6C and 6D). The security key can lift one or more key pins, which in turn lift corresponding driver pins by a distance sufficient to align a gap between each key pin and corresponding driver pin with the sheer line defined by the outer cylindrical surface of key-release plug 628 and the inner cylindrical surface of code-release hull 630. When the gap between each key pin and corresponding driver pin is aligned with the sheer line, the driver pins no longer obstruct the rotation of key-release plug 628 relative to code-release hull 630.

Accordingly, it will be appreciated that when a security key is inserted into key-receiving slot 623, key-release plug 628 becomes rotatable relative to code-release hull 630. When key-release plug 628 becomes rotatable, a rotation of knob 620 results in knob 620 engaging and rotating key-release plug 628, which itself engages and rotates core-extending member 632. Core-extending member 632 in turn engages and rotates latch engagement member 634. Rectangular engagement portion 642 of latch engagement member 634 is moved downwardly, engaging the rear inner surface of proximal portion 644 of latch 616. As a result, latch 616 is pushed downwardly and retracts into inner housing 612, causing sloped distal portion 646 of latch 616 to move away from flange 604 of cooperating member 600.

It will further be appreciated that if no security key is inserted, key-release plug 628 cannot rotate relative to code-release hull 630, due to the driver pins interlocking the two members and obstructing such rotation. If, however, a correct security code is entered using combination wheels 624, then core-locking rod 638 disengages from notch 640, allowing code-release hull 630 to rotate relative to core housing groove 631. In this case, a rotation of knob 620 causes key-release plug 628 to engage code-release hull 630, resulting in both key-release plug 628 and code-release hull 630 to rotate relative to core housing groove 631. As both components rotate, key-release plug 628 engages and rotates core-extending member 632, in turn rotating latch-engagement member 634 and moving rectangular engagement portion 642 downwardly to retract latch 616 into inner housing 612.

If neither a security key is inserted into key-receiving slot 623 nor a correct code is entered using combination wheels 624, key-release plug 628 remains interlocked with code-release hull 630, which itself is locked in place by core-locking rod 638. In this case, key-release plug is incapable of being rotated to manipulate the remaining components of the locking mechanism to retract latch 616 into inner housing 612.

It will be appreciated that while door-lock assembly 611 is described as utilizing both a key-entry mechanism and a code-input mechanism to limit unauthorized access to security console 100, in a different embodiment, door-lock assembly 611 may utilize only one of these release mechanisms, or may utilize a different release mechanism capable of performing the functions as described herein.

Figure 7A:
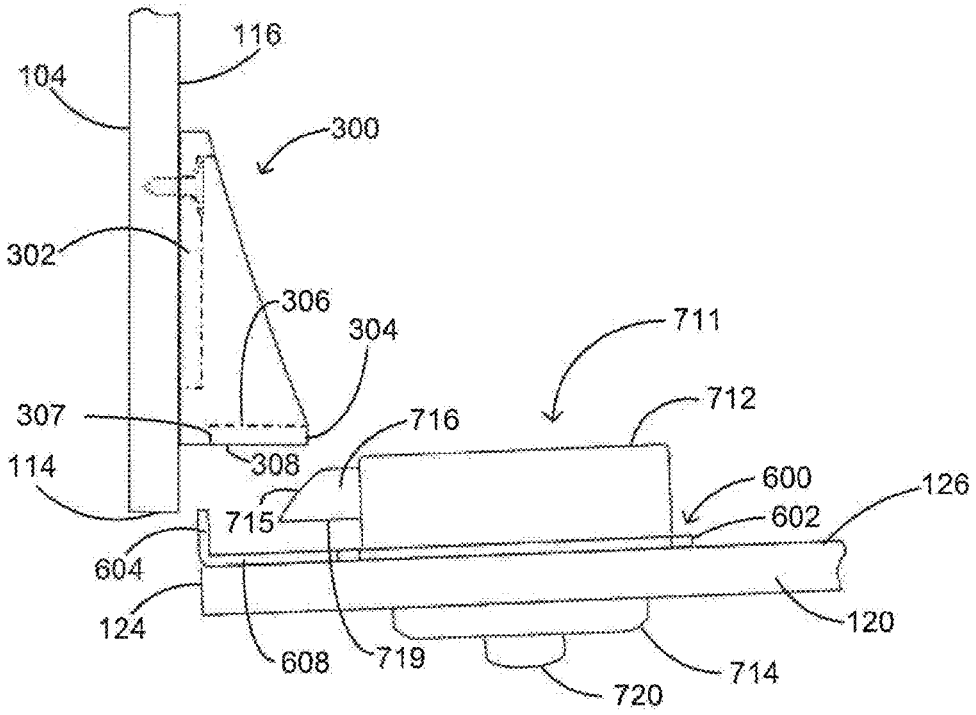
FIG. 7A is a top sectional view of a portion of a security console comprising another embodiment of the security assembly.
Figure 7B:
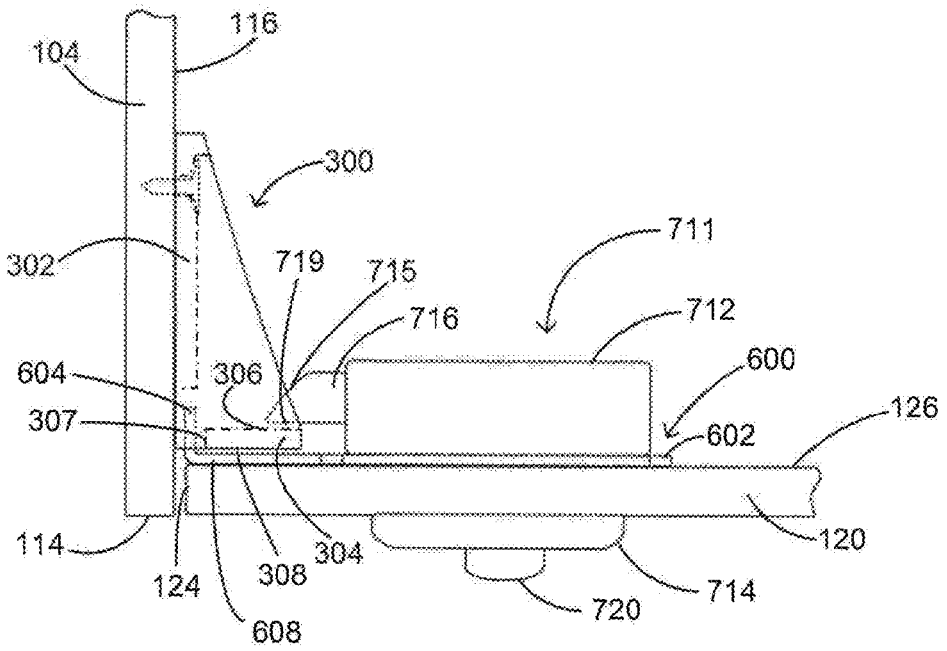
FIG. 7B is another top sectional view of the portion of the security console comprising the security assembly of FIG. 7A.

FIGS. 7A and 7B provide top sectional views of a portion of security console 100 including cooperating member 300, cooperating member 600, and door-lock assembly 700. FIG. 7A shows door 120 in a partially open position, and FIG. 7B shows door 120 in a closed position.

Door-lock assembly 711 may be similar to door-lock assembly 611. Accordingly, inner housing 712 and outer housing 714 of door-lock assembly 711 can correspond to inner housing 612 and outer housing 614 of door-lock assembly 611, and can house a locking mechanism similar to that described with reference to door-lock assembly 611. Further, latch 716 and knob 720 can provide functionality and interact in a manner similar to that described with respect to latch 616 and knob 620, respectively, of door-lock assembly 611.

Unlike door-lock assembly 611, door-lock assembly 711 does not include a support plate similar to support plate 613 of door-lock assembly 611. Accordingly, in this embodiment, cooperating member 600 is positioned directly against inner surface 126 of door 120.

It will nonetheless be appreciated that door-lock assembly 711 and cooperating member 600 can be mounted to door 120 in an integrated manner similar to that described with reference to FIGS. 6A-6D and door-lock assembly 611. Further, cooperating member 300 can be mounted to inner surface 116 of left sidewall 104 as described with reference to FIG. 4, above.

Referring to FIG. 7B, it will be appreciated that as door 120 is moved from the open position to the closed position, sloped distal portion 746 of latch 716 engages front surface 308 of cooperating member 300, causing latch 716 to retract from an extended position into inner housing 712, thereby allowing latch 716 to move past front wall 304. In one aspect, latch 716 may be spring biased. As a result, when latch 716 passes front wall 304, latch 716 can return to an extended position, resulting in flat engagement surface 719 of latch 716 being adjacent to inward-facing surface 306 of front wall 304.

Accordingly, when door 120 is in the closed position, any attempt to move the door from the closed position to the open position without using knob 720 to retract latch 716 into inner housing 712 brings flat engagement surface 719 of latch 716 into engagement with inward-facing surface 306. In this way, front wall 304 of cooperating member 300 acts as a striking member that prevents door 120 from being opened without the use of a security key or security code that allows knob 720 to be rotated to retract latch 716 so it disengages inward-facing surface 306.

Further, when door 120 is in the closed position, tab 608 of cooperating member 600 is adjacent to front surface 308 of cooperating member 300, and flange 604 is received and securely engaged with elongated opening 310. When securely engaged, flange 604 is adjacent to strike surface 307 of front wall 304. As a result, an attempt to separate left sidewall 104 from left edge 124 of door 120 brings flange 604 into engagement with strike surface 307 of front wall 304. In this way, lateral deflection of left sidewall 104 relative to left edge 124 of door 120 is restricted, making unauthorized entry into security console 100 more difficult.

For example, a person may wish to gain unauthorized access to the contents stored in the interior of locked security console 100. To do so, the person may insert a narrow tool between left edge 124 of door 120 and left sidewall 104, in an attempt to pry left sidewall 104 away from left edge 124 of door 120 by a distance sufficient to move cooperating member 300 away from latch 716, such that latch 716 can move past front wall 304 in a fully extended position without engaging inward-facing surface 306. However, as explained above, an attempt to pry left sidewall 104 away from left edge 124 of door 120 in this manner results in flange 604 engaging strike surface 307, thus restricting lateral deflection of left sidewall 104 and making it difficult to disengage latch 716 from cooperating member 300.

It will be appreciated that in some embodiments, door-lock assembly 611 or 711 may be replaced with an alternative door-lock assembly that may provide similar functionality to that described herein. For example, in one embodiment, an electronic door-lock assembly may be used.

It will further be appreciated that while the embodiments described above with reference to FIGS. 6 and 7 involve integrating door-lock assembly 611 or 711 with cooperating member 600, in alternative embodiments, a door-lock assembly may be mounted above or below cooperating member 600, or alternatively, above or below cooperating member 200, instead of being integrated therewith. In this case, a separate striking member can be provided on inner surface 116 of left sidewall 104 and positioned to engage the latch of the door-lock assembly to secure the door in the closed position.

For example, in one embodiment, cooperating member 200 and cooperating member 300 may be positioned and mounted to security console 100 in a manner similar to that described with respect to FIGS. 4 and 5. A door-lock assembly similar to door-lock assembly 611 or 711, or any other suitable door-lock assembly, may be mounted to door 120 above cooperating member 200. In one aspect, a striking member may be mounted to inner surface 116 of left sidewall 104 above first cooperating member 300. The striking member may have a mounting base that is secured to left sidewall 104, and a strike portion configured to engage the latch of the door lock assembly. The strike portion may be, for example, an inner surface of a recess formed in the mounting base, or an inner surface of a sidewall extending away form and being perpendicular to the mounting base.

In any case, the striking member can be positioned such that when the door is in the closed position, the latch of the door-lock assembly is configured to engage the strike portion of the striking member. In this way, when the door is locked, the latch of the door-lock assembly can engage the strike portion of the striking member to secure the door in the closed position, while flange 204 of cooperating member 200 can securely engage with elongated opening 310 of cooperating member 300 to restrict lateral deflection of left sidewall 104 relative to left edge 124 of door 120, thus making it more difficult to disengage the latch of the door-lock assembly from the striking member. It will be appreciated that in one aspect, a second cooperating member 300 can be used as the striking member for engaging the latch of the door-lock assembly.

It will further be appreciated that instead of mounting a striking member to inner surface 116 of left sidewall 104, an existing portion of the security console may be used as a striking portion for engaging the latch of the door-lock assembly. For example, the door-lock assembly may be mounted to door 120, near left edge 124 of door 124 and above cooperating member 200. In one aspect, a recess may be provided on inner surface 116 of left sidewall 104 above cooperating member 300, and can be configured to receive and engage the latch of the door-lock assembly to secure the door when it is in the closed position.

In one embodiment, cooperating members 200 (or 600) and 300 may be provided as an after-market security assembly. For example, a security console may have an existing door-lock assembly installed. In this case, cooperating members 200 and 300 may be mounted above or below the existing door-lock assembly to restrict the lateral deflection of a side wall of the security console relative to the door.

In a further embodiment, a plurality of cooperating members 200 and 300 may be utilized. For example, a first cooperating member 200 and a first cooperating member 300 may be mounted above an existing door-lock assembly, while a second cooperating member 200 and a second cooperating member 300 may be mounted below the existing door-lock assembly.

The present invention has been described here by way of example only. Various modification and variations may be made to these exemplary embodiments without departing from the spirit and scope of the invention, which is limited only by the appended claims.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. A security console comprising:

a body having a plurality of walls defining an interior space for storing contents;

a door rotatably coupled to the body along a fixed edge of the door and movable between open and closed positions to provide and restrict, respectively, access to the interior space; and a security assembly including a first cooperating member mounted to the door, and a second cooperating member mounted within the interior space to an inner surface of a wall of the body, the wall adjacent a free edge of the door when the door is in the dosed position, the first cooperating member configured to securely engage the second cooperating member to restrict lateral deflection of the wall relative to the free edge of the door when the door is in the closed position, wherein the first operating member includes a first base portion disposed between an inner surface of the door and the second cooperating member when the door is in the closed position, the inner surface of the door facing the interior space when the door is in the closed position.

2. The security console of claim 1 further comprising:

a door-lock assembly for selectively locking and unlocking the door, the door-lock assembly including:

a locking member, and a locking mechanism operably coupled to the locking member for moving the locking member between a locked position and, an unlocked position, wherein the door-lock assembly is mounted to the door near the free edge of the door such that:

the locking mechanism extends through an opening in the door, when the door is in the closed position, the looking member is within the security console, and a release portion of the locking mechanism is accessible from outside the security console and operable to manipulate the locking mechanism to move the locking member between the locked position and the unlocked position, when the locking member is in the unlocked position, the door is movable between the open and closed positions, and when the locking member is in the locked position and the door is in the closed position, a portion of the locking member is configured to engage a strike member of the security console to prevent the door from moving between the open and closed positions.

3. The security console of claim 2, wherein the second cooperating member is the strike member.

4. The security console of claim 3, wherein the first cooperating member is mounted between the locking member and the inner surface of the door.

5. The security console of claim 4, wherein the first cooperating member further includes an opening through which the locking mechanism extends.

6. The security console of claim 5, wherein the locking mechanism further includes:

a code-entry mechanism having a code entry portion for entering a security code; and a key-entry mechanism having a key hole for receiving a security key, the code input portion of the code-entry mechanism and the key hole of the key-entry mechanism being accessible from outside the security console, wherein the locking mechanism is configured such that the release portion of the locking mechanism is operable to manipulate the locking mechanism to move the locking member from the locked position to the unlocked position if and only if at least one of:

a unique security code is entered using the code input portion of the code-entry mechanism, and a unique security key is inserted into the key hole of the key-entry mechanism.

7. A security assembly for use with a security console having a body and a door, the body having a plurality of walls defining an interior space for storing contents, the door rotatably coupled to the body along a fixed edge of the door and movable between open and closed positions to provide and restrict, respectively, access to the interior space, said security assembly comprising:

a first cooperating member configured to be mounted to the door; and a second cooperating member configured to be mounted within the interior space to an inner surface of a wall of the body, the wall adjacent a free edge of the door when the door is in the closed position, the first cooperating member configured to securely engage the second cooperating member to restrict lateral deflection of the wall relative to the free edge of the door when the first and second cooperating members are mounted and the door is in the closed position, wherein the first cooperating member includes a first base portion configured to be disposed between an inner surface of the door and the second cooperating member when the first and second cooperating members are mounted and the door is in the closed position, the inner surface of the door facing, the interior space when the door is in the closed position.

8. The security assembly of claim 7, wherein the security console further includes:

a door-lock assembly for selectively locking and unlocking the door, the door-lock assembly including:

a locking member, and a locking mechanism operably coupled to the locking member for moving the locking member between a locked position and an unlocked position, wherein the door-lock assembly is mounted to the door near the free edge of the door such that:

the locking mechanism extends through an opening in the door, when the door is in the closed position, the locking member is within the security console, and a release portion of the locking mechanism is accessible from outside the security console and operable to manipulate the locking mechanism to move the locking member between the locked position and the unlocked position, when the locking member is in the unlocked position, the door is movable between the open and closed positions, and when the locking member is in the locked position and the door is in the closed position, a portion of the locking member is configured to engage a strike member of the security console to prevent the door from moving between the open and closed positions.

9. The security assembly of claim 8, wherein the second cooperating member is configured to be the strike member.

10. The security assembly of claim 9, wherein the first cooperating member is configured to be mounted between the locking member and the inner surface of the door.

11. The security assembly of claim 10, wherein the first cooperating member further includes an opening and is configured to be mounted such that the locking mechanism extends through the opening of the first cooperating member.

12. The security assembly of claim 11, wherein the locking mechanism further includes:

a code-entry mechanism having a code entry portion for entering a security code; and a key-entry mechanism having a key hole for receiving a security key, the door-lock assembly configured to be mounted such that the code input portion of the code-entry mechanism and the key hole of the key-entry mechanism are accessible from outside the security console, wherein the locking mechanism is configured such that the release portion of the locking mechanism is operable to manipulate the locking mechanism to move the locking member from the locked position to the unlocked position if and only if at least one of:

a unique security code is entered using the code input portion of the code-entry mechanism, and a unique security key is inserted into the key hole of the key-entry mechanism.

13. The security console of claim 1, wherein the first base portion is mounted against the inner surface of the door.

14. The security console of claim 1, wherein the first cooperating member includes an extending portion extending perpendicular to and away from the inner surface of the door, and when the door is in the closed position, the extending portion is disposed within the interior space and configured to securely engage the first second cooperating member to restrict lateral deflection of the wall relative to the free edge of the door.

15. The security console of claim 1, wherein the first cooperating member is substantially not visible from outside the security console when the door is in the closed position.

16. The security console of claim 1, wherein the second cooperating member includes a second base portion mounted to the wall and a front surface perpendicular to the second base portion, the front surface having an opening receding into the second base portion, the opening configured to receive an extending portion of the first cooperating member to restrict lateral deflection of the wall relative to the free edge of the door when the door is in the closed position.

17. The security assembly of claim 7, wherein the second cooperating member includes a second base portion configured to be mounted to the wall and a front surface perpendicular to the second base portion, the front surface having an opening receding into the second base portion, the opening configured to receive an extending portion of the first cooperating member to restrict lateral deflection of the wall relative to the free edge of the door when the first and second cooperating members are mounted and the door is in the closed position.

18. The security assembly of claim 7, wherein the first base portion is configured to be mounted against the inner surface of the door.

19. The security assembly of claim 7, wherein the first cooperating member includes an extending portion extending perpendicular to and away from the first base portion, the extending portion configured to be disposed within the interior space and to securely engage the second cooperating member to restrict lateral deflection of the wall relative to the free edge of the door when the first and second cooperating members are mounted and the door is in the closed position.

20. The security assembly of claim 7, wherein the first cooperating member is configured to be substantially not visible from outside the security console when the first cooperating member is mounted and the door is in the closed position.

21. The security console of claim 14, wherein the second cooperating member includes a front surface perpendicular to the inner surface of the wall and facing the first base portion when the door is in the closed position, the front surface having an opening configured to receive the extending portion of the first cooperating member when the door is in the closed position.

22. The security console of claim 14, wherein the extending portion comprises a flange extending from a peripheral edge of the first base portion.

23. The security assembly of claim 19, wherein the second cooperating member includes a generally planar second base portion configured to be mounted to the inner surface of the wall, and a front surface perpendicular to the second base portion, the front surface having an opening configured to receive the extending portion of the first cooperating member when the first and second cooperating members are mounted and the door is in the closed position.

24. The security assembly of claim 19, wherein the extending portion comprises a flange extending from a peripheral edge of the first base portion.

25. A security console comprising:

a body having a plurality of walls defining an interior space for storing contents;

a door rotatably coupled to the body along a fixed edge of the door and movable between open and closed positions to provide and restrict, respectively, access to the interior space; and a security assembly including a first cooperating member mounted to the door, and a second cooperating member mounted within the interior space to an inner surface of a wall of the body, the wall adjacent a free edge of the door when the door is in the closed position, the first cooperating member configured to securely engage the second cooperating member to restrict lateral deflection of the wall relative to the free edge of the door when the door is in the closed position, wherein the second cooperating member includes a second base portion mounted to the wall and a front surface perpendicular to the second base portion, the front surface having an opening receding into the second base portion, the opening configured to receive an extending portion of the first cooperating member to restrict lateral deflection of the wall relative to the free edge of the door when the door is in the closed position.

26. A security assembly for use with a security console having a body and a door, the body having a plurality of walls defining an interior space for storing contents, the door rotatably coupled to the body along a fixed edge of the door and movable between open and closed positions to provide and restrict, respectively, access to the interior space, said security assembly comprising:

a first cooperating member configured to be mounted to the door; and a second cooperating member configured to be mounted within the interior space to an inner surface of a wall of the body, the wall adjacent a free edge of the door when the door is in the closed position, the first cooperating member configured to securely engage the second cooperating member to restrict lateral deflection of the wall relative to the free edge of the door when the first and second cooperating members are mounted and the door is in the closed position, wherein the second cooperating member includes a second base portion configured to be mounted to the wall and a front surface perpendicular to the second base portion, the front surface having an opening receding into the second base portion, the opening configured to receive an extending portion of the first cooperating member to restrict lateral deflection of the wall relative to the free edge of the door when the first and second cooperating members are mounted and the door is in the closed position.

* * * * *